United States Patent [19]

Hokama

[11] 4,211,246

[45] Jul. 8, 1980

[54] MANICURE NAIL SMOOTHING AND BUFFING

[75] Inventor: Yosh Hokama, Torrance, Calif.

[73] Assignee: International Beauty Distributor, Gardena, Calif.

[21] Appl. No.: 949,625

[22] Filed: Oct. 10, 1978

[51] Int. Cl.[2] ..... A45D 29/04
[52] U.S. Cl. ..... 132/76.4
[58] Field of Search ..... 132/73, 75.6, 76.4

[56] References Cited

U.S. PATENT DOCUMENTS

| | | | |
|---|---|---|---|
| 878,881 | 2/1908 | Hopkins | 132/76.4 |
| 1,134,088 | 3/1915 | Mendelsohn | 132/75.6 |
| 1,370,753 | 3/1921 | Loring | 132/76.4 |
| 2,546,118 | 3/1951 | Wright | 132/73 |

*Primary Examiner*—G. E. McNeill
*Attorney, Agent, or Firm*—William W. Haefliger

[57] ABSTRACT

Manicure nail processing apparatus is constructed to carry two fingernail processing elements, and to be hand-held, so that one element is presented to fingernails with the manicurist's fingers in non-folded condition, and the other element is presented to fingernails with the manicurist's fingers in folded condition.

1 Claim, 9 Drawing Figures

MANICURE NAIL SMOOTHING AND BUFFING

BACKGROUND OF THE INVENTION

This invention relates generally to apparatus used by manicurists to smooth and buff fingernails. More specifically it concerns a unitary device capable of convenient use to carry out both of these functions, or similar functions.

At the present time and in the past, manicurists accomplished smoothing and buffing of fingernails by using two different devices. It was therefore necessary to repeatedly lay one device down, pick up the other device and adjust his hand or fingers to it in order to accurately smooth and then buff fingernails, whereby time and effort were wasted. Such wastage is seen to be enhanced by virtue of the fact that the manicurist might switch between these tools several times in processing each fingernail.

SUMMARY OF THE INVENTION

It is a major object of the invention to provide apparatus overcoming the time wastage problems referred to above, and also characterized as automatically adjusting the manicurists hand to a device capable of both functions, i.e. both smoothing and buffing of fingernails, for example.

Basically, the apparatus comprises:

(a) a lower endwise elongated support to carry a first fingernail processing element at the lower side thereof, (b) an upper endwise elongated support above the lower support to carry a second fingernail processing element on the upper side thereof, (c) means interconnecting said supports and holding them in vertically spaced relation, thereby to provide a space between the supports to closely receive a manicurist's fingers whereby the lower support may then be endwise reciprocated over a fingernail, (d) said means accommodating inversion of the apparatus when the manicurist's finger are folded to invert the upper support into position below the lower support, thereby allowing the upper support to be endwise reciprocated over the fingernail.

As will appear, the support interconnecting means may also define an endwise facing, recessed shoulder to be gripped by a manicurist's thumb when his or her fingers received in the space between the supports are folded to invert the device, thereby imparting additional stability to the device and accommodating it to the user's fist formed by finger folding. The supports may respectively carry smoothing and buffing strips, and posts may interconnect the two supports, as will be described, and with accommodation to the fingers of the user-manicurist, so that back and forth movement of the device may be carried out comfortably.

These and other objects and advantages of the invention, as well as the details of an illustrative embodiment, will be more fully understood from the following description and drawings, in which:

DRAWING DESCRIPTION

DETAILED DESCRIPTION

Figure 1:
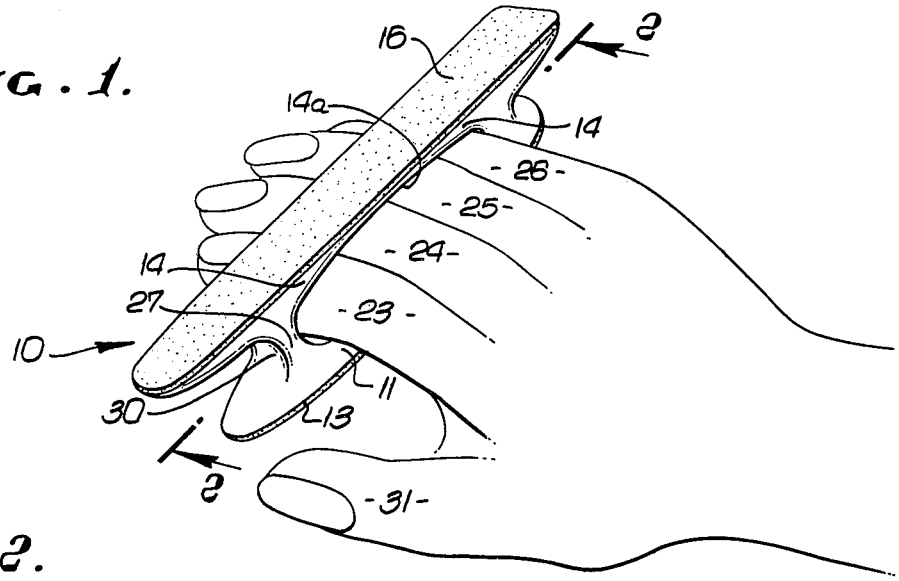
FIG. 1 is a perspective showing of apparatus incorporating the invention, and in upright, finger held position.
Figure 2:
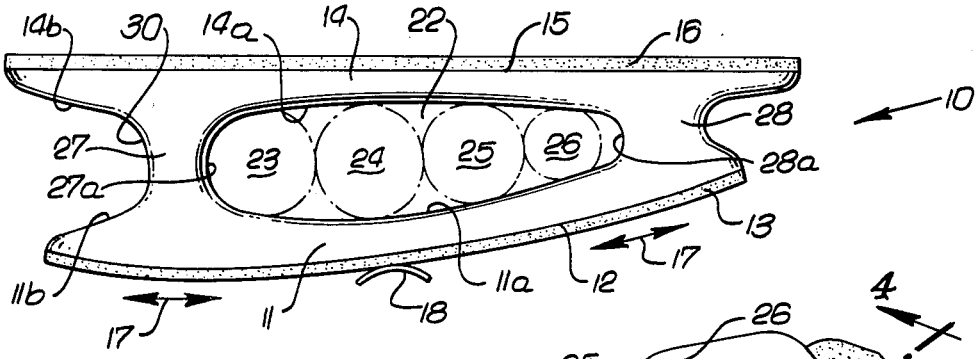
FIG. 2 is an enlarged elevation on lines 2—2 of FIG. 1.

In FIGS. 1 and 2, the apparatus or device 10 comprises a lower, endwise elongated support 11 having a lower side 12 to carry a first fingernail processing element exposed at said lower side. That element may typically comprise a fingernail smoothing strip 13 bonded to side 12. The apparatus also includes an upper, endwise elongated support 14 above the lower support and having an upper side 15 to carry a second fingernail processing element exposed at that upper side. That second element may typically comprise a fingernail buffing strip 16 bonded to side 15. The smoothing strip 13 is characterized as carrying a surface coating of very fine abrasive (i.e. almost of jeweler's range quality) to smooth off the natural striations or lines on a fingernail upper surface when that strip is reciprocated endwise back and forth in the direction indicated by arrows 17 in FIG. 2, with strip 13 engaging the nail seen at 18. The strip 13 itself may consist of a cushioning material, such as soft rubber.

Figure 4:
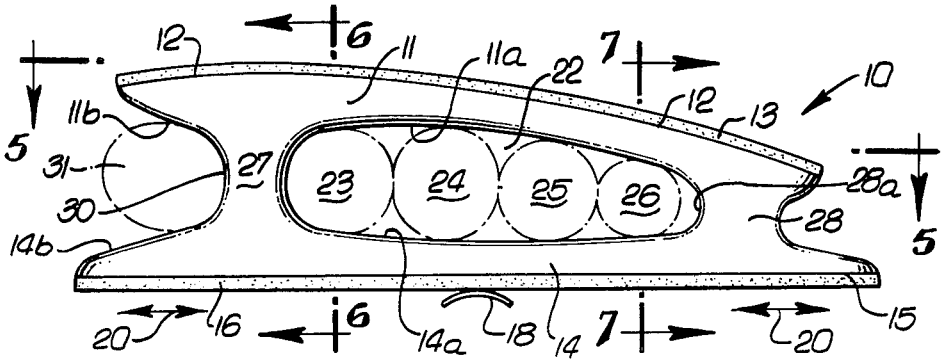
FIG. 4 is an elevation on lines 4—4 of FIG. 3.
Figure 5:
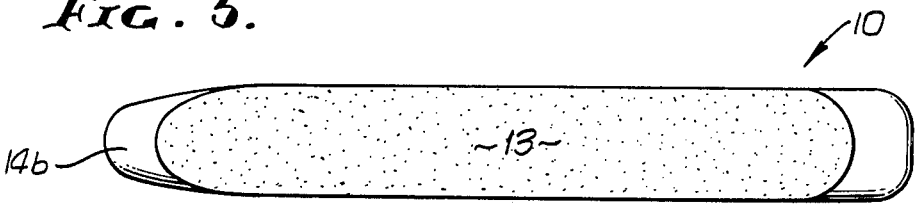
FIG. 5 is a plan view on lines 5—5 of FIG. 4.

The buffing strip 16 is characterized as carrying a surface coating of extremely fine abrasive or polishing media to buff and polish the nail from which striations have been removed. FIG. 4 shows the device 10 inverted, with strip 16 engaging the nail 18, it being understood that strip 16 is to be moved endwise back and forth (indicated by arrows 20) in contact with the nail, and with rocking motion, as desired, to effect buffing of the entire nail.

Figure 6:
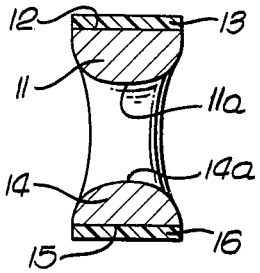
FIG. 6 is a vertical section on lines 6—6 of FIG. 4.

In accordance with an important aspect of the invention, means is provided to interconnect the two supports 11 and 14 for holding them in vertically spaced relation, thereby to provide a space 22 between them to closely receive a manicurist's fingers whereby the device may be moved endwise back and forth as described. This is seen in FIGS. 1 and 2, with the manicurist's fingers 23–26 inserted straight through the endwise elongated space between a pair of posts 27 and 28 which extend between the supports at the opposite ends of space 22, the posts being integral with the supports. The posts have smoothly concavely rounded surface extends 27*a* and 28*a* facing recess 22 to comfortably engage the fingers 23 and 26; also the underside 14*a* of support 14, and the upperside 11*a* of support 11 are convex in planes normal to the directions of elongation of the supports, as is clear from FIGS. 6 and 7. Thus, all the fingers comfortably engage these sides 11*a* and 14*a* both in upright and inverted positions of the device, as will further be explained.

Figure 3:
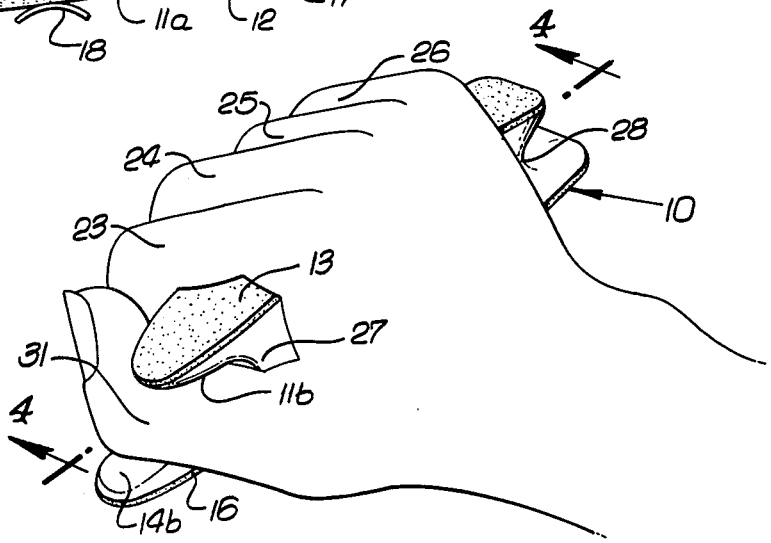
FIG. 3 is a perspective showing of the FIG. 1 apparatus in inverted and fist gripped position.

It is an important feature of the invention that the described means accommodates inversion of the apparatus when the manicurist's fingers are folded (as in FIG. 3) to invert the upper support into position below the lower support, thereby allowing the upper support to be endwise reciprocated over the fingernail, as seen in FIG. 4. In addition, this mode may be further accommodated to formation of a fist, by provision of an endwise facing, recessed shoulder 30 to be gripped by the manicurist's thumb 31 when the fingers 23–26 in space 22 are folded as previously described (see FIGS. 3 and 4). Post 27 forms shoulder 30 in the illustrated form of the invention, and that shoulder may be concave in the plane of FIG. 4, to smoothly merge with rounded surfaces 14*b* of the upper support 14, and 11*b* of the lower support 11. Surfaces 11*b* and 14*b* comfortably engage the inside fleshy part of the thumb, as seen in FIG. 3, whereby the entire apparatus comfortably conforms to the user's fist in the buffing mode.

Figure 7:
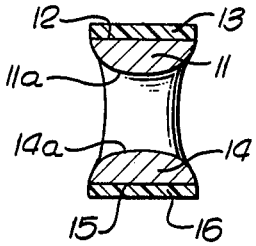
FIG. 7 is a vertical section on lines 7—7 of FIG. 4.

The modified device shown at 110 in FIG. 7 is similar to that at 10 in FIGS. 2 and 4, and corresponding elements are given numbers the second and third digits of which are the same as appear in FIGS. 2 and 4. The numeral 1 appears as the first digit in each such number. Post 127 is of greater vertical length than post 128, and the two supports 111 and 114 taper in their leftward endwise elongated directions. Thus, space 122 progressively narrows in width in direction 150, i.e. in the taper direction, to accommodate to progressively narrow widths of fingers to be inserted in to space 122. Note that device 110 is endwise reversed, as shown, as compared to device 10.

Figure 8:
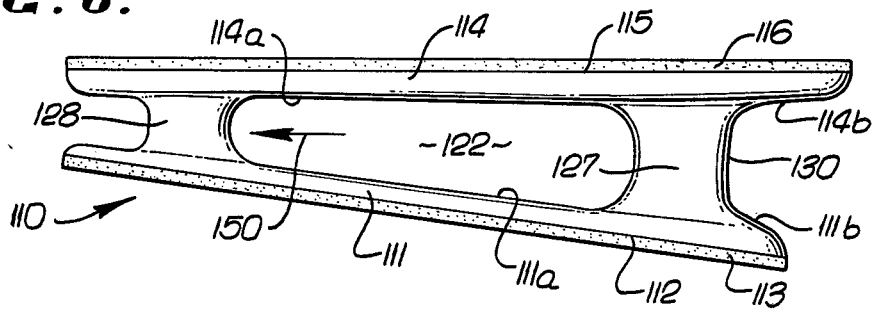
FIGS. 8 and 9 are elevations showing modified devices incorporating the invention.
Figure 9:
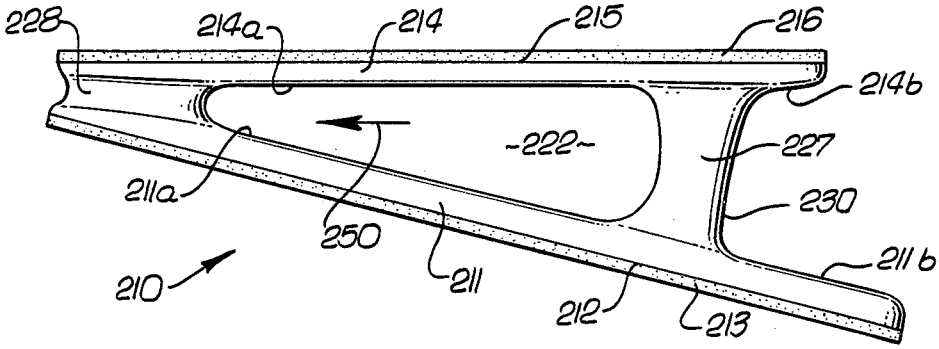

The modified device 210 shown in FIG. 8 is also similar to that seen at 10 in FIGS. 2 and 4. Corresponding elements are given numbers the second and third digits of which are the same as appear in FIGS. 2 and 4, the numeral 2 appears as the first digit of each such number. Post 227 is of greater vertical length than post 228, the latter actually defining a merging zone of the two supports 211 and 214. Space 222 tapers or narrows in direction 250, and the two supports 211 and 214 taper leftwardly. Extent 211*b* of support 211 is elongated rightwardly to provide extensive and firm support for the fleshy area of the user's thumb, as described above.

I claim:

1. In a manicure nail processing apparatus, the combination comprising:

(a) a lower endwise elongated support to carry a first fingernail processing element at the lower side thereof, (b) an upper endwise elongated support above the lower support to carry a second fingernail processing element on the upper side thereof, (c) two horizontally spaced posts extending vertically between said two supports and interconnecting said supports and holding them in vertically spaced relation, thereby to provide a space vertically between the supports and horizontally elongated between the two posts to closely receive a manicurist's fingers whereby the lower support may then be endwise reciprocated over a fingernail, said two supports extending continuously between said posts, (d) one of said posts and portions of said two supports defining an endwise openly facing recessed shoulder to be gripped by a manicurist's thumb when the manicurist's fingers received in said space are folded to invert said upper support into position below the lower support thereby allowing the manicurist's hand to form a fist gripping said apparatus, whereby the inverted upper support may then be endwise reciprocated over said fingernail.

* * * * *